US008393685B2

(12) United States Patent
Hill

(10) Patent No.: US 8,393,685 B2
(45) Date of Patent: Mar. 12, 2013

(54) INTERLOCKING PRECAST SLAB ASSEMBLY SUCH AS A BENCH OR A MEMORIAL MARKER

(76) Inventor: Dennis Michael Hill, St. Clair, MI (US)

( * ) Notice: Subject to any disclaimer, the term of this patent is extended or adjusted under 35 U.S.C. 154(b) by 327 days.

(21) Appl. No.: 12/606,692

(22) Filed: Oct. 27, 2009

(65) Prior Publication Data

US 2011/0094168 A1 Apr. 28, 2011

(51) Int. Cl.
*A47C 7/00* (2006.01)

(52) U.S. Cl. ..... 297/440.13; 297/440.14; 297/440.15

(58) Field of Classification Search ..... 52/103, 52/105; 297/440.1, 440.14, 440.13, 232, 297/440.15
See application file for complete search history.

(56) References Cited

U.S. PATENT DOCUMENTS

| | | | | | |
|---|---|---|---|---|---|
| 604,658 | A | | 5/1898 | Forster | |
| 948,770 | A | | 2/1910 | Price | |
| 1,078,810 | A | | 11/1913 | Van Derveer | |
| 1,626,095 | A | | 4/1927 | Ramsburg | |
| 1,639,085 | A | * | 8/1927 | Fohey | 297/188.04 |
| 1,756,351 | A | | 4/1930 | Gentile | |
| 1,862,382 | A | | 6/1932 | Mathis | |
| 1,886,988 | A | | 11/1932 | Thelen | |
| 2,659,422 | A | | 11/1953 | Holland | |
| 2,711,786 | A | * | 6/1955 | Weiss | 297/452.14 |
| 3,756,657 | A | | 9/1973 | Johnson | |
| 4,600,251 | A | | 7/1986 | Zimmerman | |
| 5,329,716 | A | * | 7/1994 | Fite | 40/575 |
| 5,404,343 | A | * | 4/1995 | Boggio | 369/19 |
| 5,546,710 | A | * | 8/1996 | Barry | 52/104 |
| 5,729,921 | A | * | 3/1998 | Rojas | 40/124.5 |
| 5,732,515 | A | * | 3/1998 | Rodrigues et al. | 52/103 |
| 5,887,389 | A | * | 3/1999 | Light | 52/105 |
| 6,090,324 | A | | 7/2000 | Keady | |
| 6,203,643 | B1 | * | 3/2001 | Gaunt et al. | 156/153 |
| 6,413,007 | B1 | | 7/2002 | Lambright | |
| 6,414,663 | B1 | * | 7/2002 | Manross, Jr. | 345/87 |
| 6,463,703 | B1 | * | 10/2002 | Mattis | 52/103 |
| D484,714 | S | | 1/2004 | Que | |
| 6,887,010 | B2 | | 5/2005 | Mayer Rodis | |
| 7,287,225 | B2 | * | 10/2007 | Mindrum | 715/716 |
| 7,716,878 | B1 | * | 5/2010 | Altman | 52/103 |
| 2005/0161985 | A1 | | 7/2005 | Austin | |

OTHER PUBLICATIONS

Reckli GmbH—"Photo-Engraving Formliners" download, website: http://www.reckli.net/foto-gravur-matrizen.html?&L=5; dated Jan. 2009.

* cited by examiner

*Primary Examiner* — Joshua J Michener
*Assistant Examiner* — Chi Q Nguyen
(74) *Attorney, Agent, or Firm* — Brooks Kushman P.C.

(57) ABSTRACT

An interlocking precast slab assembly such as a bench or memorial marker is provided. Each assembly includes a precast seat member having upper and lower surfaces and an elongated groove formed in the upper surface of the seat member. Each assembly also includes a precast back member having an engraved front surface and an elongated lower edge portion which fits into the elongated groove to form a joint which interlocks the members together to form the assembly with the engraved front surface supported above the upper surface of the seat member for viewing.

20 Claims, 3 Drawing Sheets

INTERLOCKING PRECAST SLAB ASSEMBLY SUCH AS A BENCH OR A MEMORIAL MARKER

BACKGROUND OF THE INVENTION

1. Field of the Invention

This invention relates to an interlocking precast slab assemblies such as benches and memorial markers.

2. Background Art

Precast concrete is concrete in the form of blocks, pillars, bridge sections and the like that have been cast into forms before being put into position. Such concrete can be assembled into a variety of structures such as benches. For example:

- U.S. Pat. No. 2,659,422 discloses a concrete bench, including advertising space on the back thereof;
- U.S. Pat. No. 3,756,657 discloses a concrete bench per se;
- U.S. Pat. No. 1,862,382 discloses a concrete bench formed in a number of sections, wherein the back section is cast as a single long slab;
- U.S. Pat. No. 1,886,988 discloses a bench constructed of cement for outdoor use which is cast in two sections—a leg section or base and a seat section;
- U.S. Pat. No. 1,626,095 discloses a florist bench made of concrete and which is formed of sections;
- U.S. Pat. No. 948,770 discloses a seat constructed of cement;
- U.S. Design Pat. No. D484,714 discloses a concrete and steel bench;
- U.S. Pat. No. 6,887,010 disclose a decorative bench;
- U.S. Pat. No. 6,090,324 discloses a forming system for stone or concrete benches; and
- U.S. Published Patent Application No. 2005/0161985 discloses a stone or masonry bench having upright supports, a bottom seat and an optional upright back support.

The following U.S. patent documents are also related: 1,756,351; 604,658; 6,413,007; 4,600,251 and 1,078,810.

Decorative concrete or grout panels or slabs can be formed from photo-engraved formliners. These formliners can be cut by CNC machines, the input of which is a digital photograph. Such concrete panels can be used as decorative pieces either standing alone or as part of a larger wall structure.

SUMMARY OF THE INVENTION

An object of the present invention is to provide an improved interlocking precast slab assembly such as a bench or memorial marker.

In carrying out the above object and other objects an interlocking precast slab assembly is provided. The interlocking precast slab assembly includes a precast seat member having upper and lower surfaces and an elongated groove formed in the upper surface of the seat member. The interlocking precast slab assembly further includes a precast back member having an engraved front surface and an elongated lower edge portion which fits into the elongated groove to form a joint which interlocks the members together to form the assembly with the engraved front surface supported above the upper surface of the seat member for viewing.

The front surface of the back member may be engraved with a design.

The front surface of the back member may be engraved with indicia which represent at least one of a name and a date.

The front surface of the back member may be engraved with a memorial inscription.

The front surface of the back member may be engraved with an image.

The image may be a photo-realistic image.

The photo-realistic image may include at least one human image.

The back member may be a marker.

The assembly may further include a precast support for supporting the seat member at a desired height. The assembly may include a bench or a seat.

The front surface of the back member may be engraved with a memorial inscription. The bench or seat may be a memorial bench or a memorial seat, respectively.

The seat member may have an elongated groove formed in the lower surface. The support may have an upper edge portion which fits into the elongated groove formed in the lower surface to form a joint which interlocks the seat member and the support together.

The seat member may have a pair of spaced elongated grooves formed in the lower surface. The support may have a pair of spaced upper edge portions which fit into their respective elongated grooves formed in the lower surface to form a pair of spaced joints which interlock the seat member and the support together.

The seat member may have an inner support surface on which the back member is supported within the groove and at least one hole which extends between and fluidly communicates the inner support surface and the bottom surface of the seat member to prevent the accumulation of liquid within the groove.

The seat member may have an inner support surface on which the back member is supported within the groove in the upper surface. The groove in the upper surface may be in fluid communication with the elongated groove formed in the lower surface of the seat member to prevent the accumulation of liquid within the groove in the upper surface.

The seat member may have an inner support surface on which the back member is supported within the groove in the upper surface. The groove in the upper surface may be in fluid communication with the spaced elongated grooves formed in the lower surface to prevent the accumulation of liquid within the groove in the upper surface.

The assembly may further include concrete or grout positioned in the elongated groove to seal the joint and rigidly lock the members together.

Further in carrying out the above object and other objects of the present invention, an interlocking precast slab bench is provided. The interlocking precast slab bench further includes a precast seat member having upper and lower surfaces, an elongated groove formed in the upper surface and a pair of spaced elongated grooves found in the lower surface. The interlocking precast slab bench still further includes a precast back member having a front surface engraved with a photo-realistic image and an elongated lower edge portion which fits into the elongated groove formed in the upper surface to form a joint which interlocks the members together with the engraved front surface supported above the upper surface of the seat member for viewing. The interlocking precast slab bench further includes a support including a pair of spaced, precast support members for supporting the seat member at a desired height. Each of the support members has an upper edge portion which fits into its respective elongated groove formed in the lower surface of the seat member to form respective joints which interlock the seat member and the support members together. The seat member has an inner support surface on which the back member is supported within the groove in the upper surface. The groove in the upper surface is in fluid communication with the spaced elongated grooves formed in the lower surface to prevent the accumulation of liquid within the groove in the upper surface.

The image may include at least one human image.

The front surface may also be engraved with a memorial inscription.

Still further in carrying out the above object and other objects of the present invention, an interlocking precast slab memorial marker is provided. The interlocking precast slab memorial marker includes a precast seat member having upper and lower surfaces, and an elongated groove formed in the upper surface of the seat member. The interlocking precast slab memorial marker further includes a precast back member having a front surface engraved with a memorial inscription including indicia which represents at least one of a name and a date and an elongated lower edge portion which fits into the elongated groove to form a joint which interlocks the members together to form the marker with the engraved front surface supported above the upper surface of the seat member for viewing. The interlocking precast slab memorial marker still further includes concrete or grout positioned in the elongated groove to seal the joint and rigidly lock the members together. The seat member has an inner support surface on which the back member is supported within the groove and at least one hole which extends between and fluidly communicates the inner support surface and the bottom surface of the seat member to prevent the accumulation of liquid within the groove.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
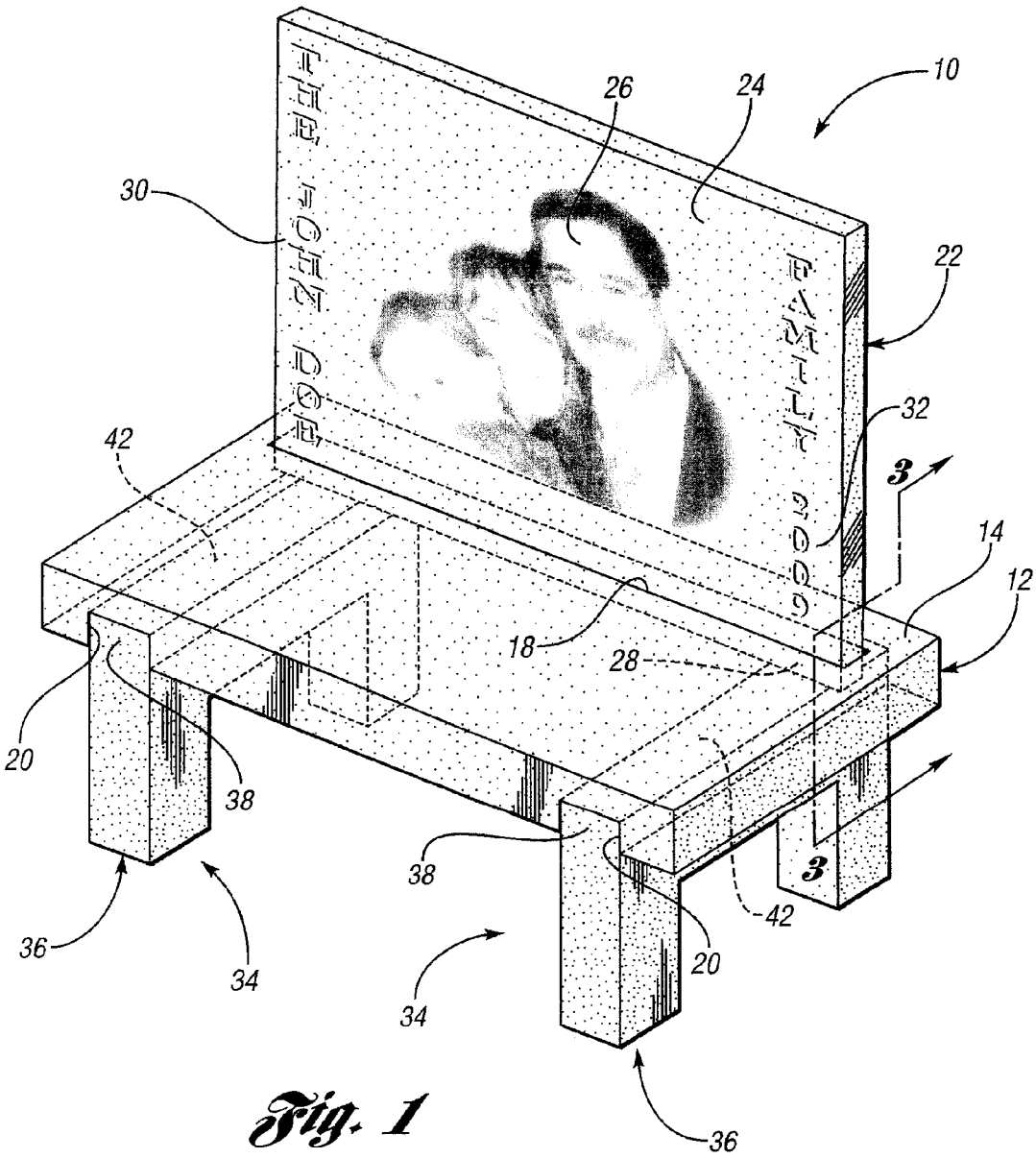
FIG. 1 is a perspective view of an interlocking precast slab assembly such as a bench constructed in accordance with an embodiment of the present invention.
Figure 2:
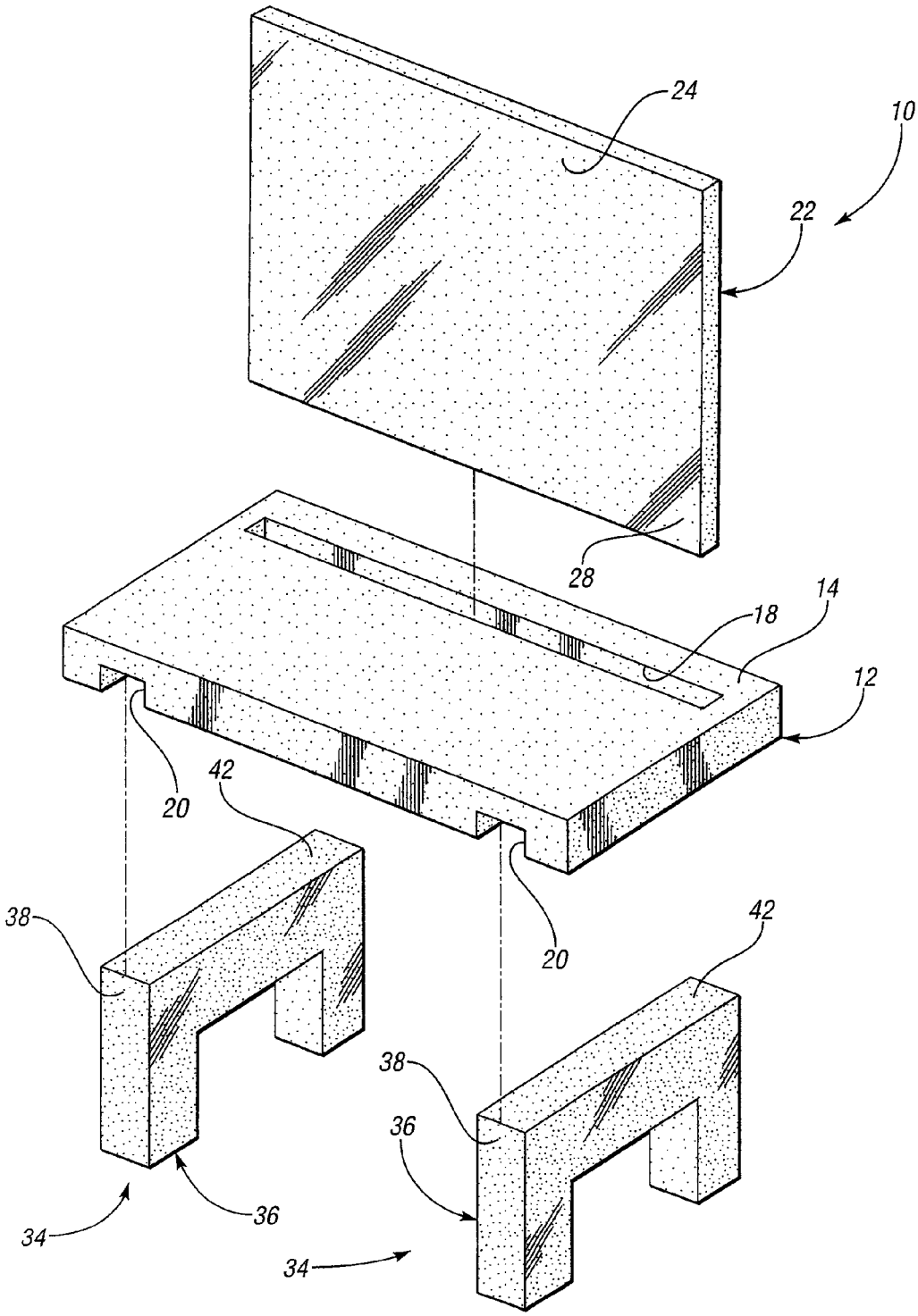
FIG. 2 is an exploded perspective view of the embodiment of FIG. 1.
Figure 3:
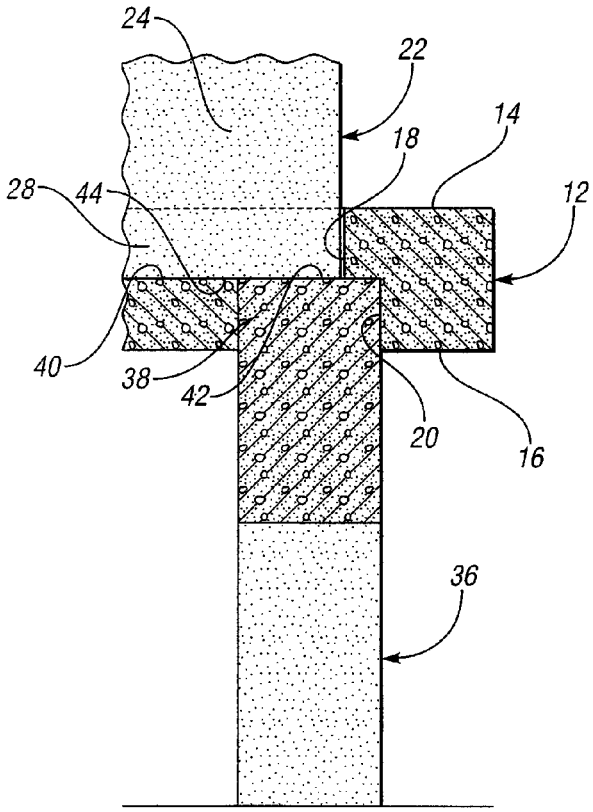
FIG. 3 is a front view, partially broken away and in cross-section, of a joint of the embodiment of FIG. 1, taken along lines 3-3 of FIG. 1.

Referring to the FIGS. 1-3, there is illustrated an interlocking precast slab assembly such as a memorial bench, generally indicated at 10. The bench includes a precast concrete seat member, generally indicated at 12, having upper and lower surfaces 14 and 16, respectively. An elongated groove 18 is formed in the upper surface 14 and a pair of spaced elongated grooves 20 are formed in the lower surface 16.

The bench 10 also includes a precast grout back member, generally indicated at 22, having a front surface 24 engraved with a design such as a photo-realistic image 26 (FIG. 1) of a family and an elongated lower edge portion 28 which fits into the elongated groove 18 formed in the upper surface 14 to form a joint which interlocks the members 12 and 22 together with the engraved front surface 24 supported above the upper surface 14 of the seat member 12 for viewing.

Preferably, the precast grout back member 22 has a plurality of closely spaced, vertically extending V-shaped grooves formed from a photo-engraved formliner. Such formliners can be cut by CNC machines, the input of which is a digital photograph. Such formliners are manufactured by Reckli GmbH. Also, preferably, the front surface 24 of the back member 22 is engraved with a memorial inscription, including indicia which represents at least one and perhaps two items such as a name 30 and date 32 associated with the photo-realistic image engraved in a front surface 24 of the back member 22 as illustrated in FIG. 1.

The bench 10 also includes a support, generally indicated at 34, including a pair of spaced, precast concrete support members, generally indicated at 36, for supporting the seat member at a desired height. Each of the support members 36 has an upper edge portion 38 which fits into its respective elongated groove 20 formed in the lower surface 16 of the seat member 12 to form respective joints which interlock the seat member 12 and the support members 36 together.

The seat member 12 has an inner support surface 40 (FIG. 3) on which the back member 22 is supported within the groove 18 in the upper surface 14. A top surface 42 of each of the support members 36 also provides support for the back member 22 at its lower surface 44. The groove 18 in the upper surface 14 is in fluid communication with the spaced elongated grooves 20 formed in the lower surface 16 to prevent the accumulation of liquid within the groove 18 in the upper surface 14.

Figure 4:
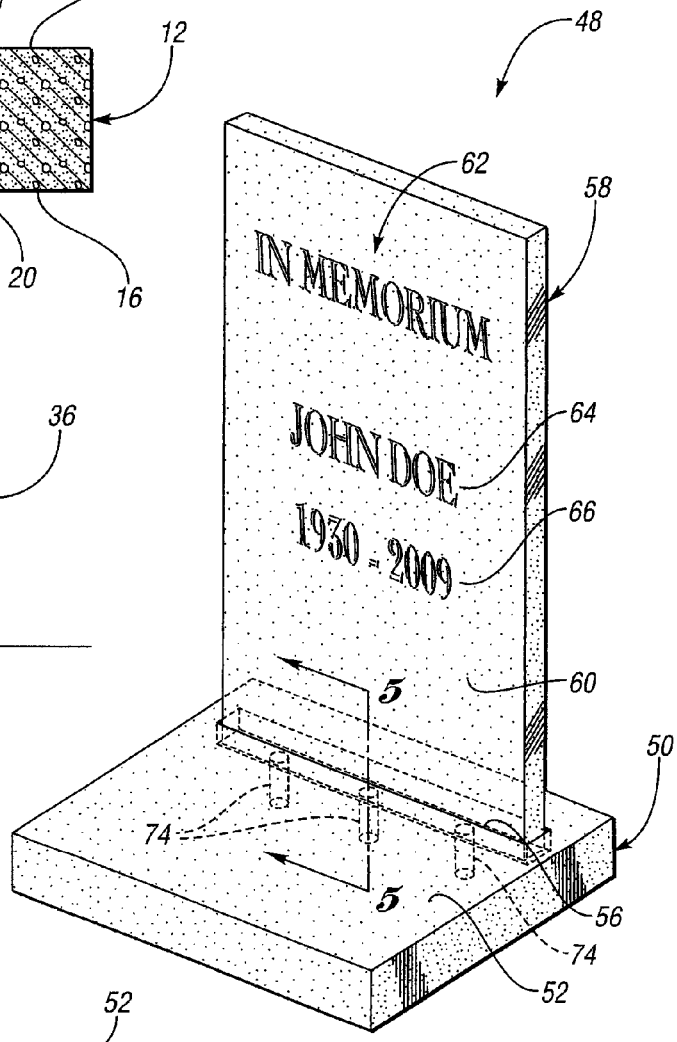
FIG. 4 is a perspective view of an interlocking precast slab assembly such as a memorial marker constructed in accordance with an embodiment of the present invention.
Figure 5:
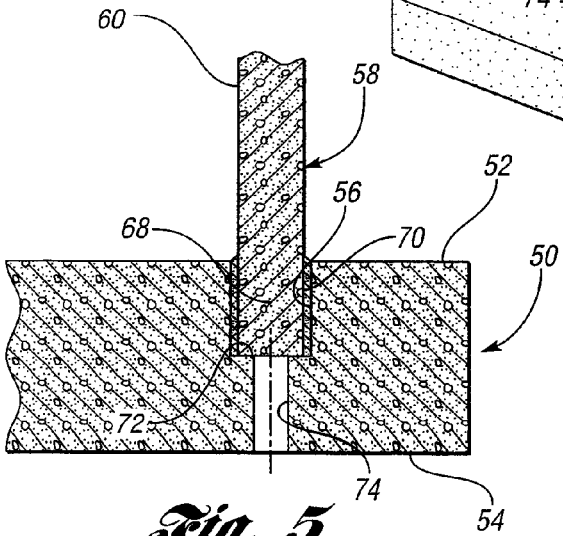
FIG. 5 is a side view, partially broken away and in cross-section, of a joint of the embodiment of FIG. 4, taken along lines 5-5 of FIG. 4.

Referring now to FIGS. 4 and 5, there is illustrated a second interlocking precast slab assembly such as a memorial marker, generally indicated at 48. The marker 48 includes a precast concrete seat member, generally indicated at 50, having upper and lower surfaces 52 and 54, respectively, and an elongated groove 56 formed in the upper surface 52 of the seat member 50.

The marker 48 also includes a precast grout back member, generally indicated at 58, having a front surface 60 engraved with a memorial inscription, generally indicated at 62, including indicia which represents at least one of a name 64 and a date 66 and an elongated lower edge portion 68 which fits into the elongated groove 56 to form a joint which interlocks the members 50 and 58 together to form the marker 48. The engraved front surface 60 is supported above the upper surface 52 of the seat member 50 for viewing.

The marker 48 further includes a concrete or grout type material 70 positioned in the elongated groove 56 to seal the joint and rigidly lock the members 50 and 58 together. The seat member 50 has an inner support surface 72 on which the back member 58 is supported within the groove 56. One or more holes 74 extend between and fluidly communicate the inner support surface 72 and the bottom surface 54 of the seat member 50 to prevent the accumulation of liquid within the groove 56.

Each of the seat members 12 and 50 and each of the support members 36 may be made of Quik-Crete Pro-Finish 5,000 psi concrete mix with stealth fiber-mesh fibers for reinforcement.

The back members 22 and 58 may be made of grey non-shrink grout. No wire or fiber mesh is typically required.

In summary, both the bench 10 (FIGS. 1-3) and the marker 48 (FIGS. 4 and 5) are interlocking precast slab assemblies including a precast seat member having upper and lower surfaces and an elongated groove formed in the upper surface of the seat member and a precast grout back member having an engraved front surface and an elongated lower edge portion which fits into the elongated groove to form a joint which interlocks the members together to form the assembly with the engraved front surface supported above the upper surface of the seat member for viewing.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An interlocking slab assembly comprising:

a precast seat member having upper and lower surfaces, a first elongated groove formed in the upper surface of the seat member, and a second elongated groove formed in the lower surface of the seat member; and a precast back member having an engraved front surface and an elongated lower edge portion which fits into the first elongated groove to form a joint which interlocks the members together to form the assembly with the engraved front surface supported above the upper surface of the seat member for viewing wherein the front surface of the back member is engraved with a photo-realistic image, and wherein the first and second elongated grooves intersect to provide fluid communication between the grooves.

2. The assembly as claimed in claim 1 wherein the front surface of the back member is engraved with a design.

3. The assembly as claimed in claim 1 wherein the front surface of the back member is engraved with indicia which represent at least one of a name and a date.

4. The assembly as claimed in claim 1 wherein the front surface of the back member is engraved with a memorial inscription.

5. The assembly as claimed in claim 1 wherein the photo-realistic image includes at least one human image.

6. The assembly as claimed in claim 1 wherein the back member is a marker.

7. The assembly as claimed in claim 1 further comprising a precast support for supporting the seat member at a desired height wherein the assembly comprises a bench or a seat.

8. The assembly as claimed in claim 7 wherein the front surface of the back member is engraved with a memorial inscription and wherein the bench or seat is a memorial bench or a memorial seat, respectively.

9. The assembly as claimed in claim 7 wherein the support has an upper edge portion which fits into the second elongated groove formed in the lower surface to form a joint which interlocks the seat member and the support together.

10. The assembly as claimed in claim 9 wherein the seat member has an inner support surface on which the back member is supported within the first groove the upper surface and wherein the first groove in the upper surface is in fluid communication with the second groove formed in the lower surface of the seat member to prevent the accumulation of liquid within the first groove in the upper surface.

11. The assembly as claimed in claim 7 wherein the seat member has a third elongated groove formed in the lower surface spaced from the second elongated groove and wherein the support has a pair of spaced upper edge portions which fit into their respective elongated grooves formed in the lower surface to form a pair of spaced joints which interlock the seat member and the support together.

12. The assembly as claimed in claim 11 wherein the seat member has an inner support surface on which the back member is supported within the first groove in the upper surface and wherein the first groove in the upper surface is in fluid communication with the second and third elongated grooves formed in the lower surface to prevent the accumulation of liquid within the first groove in the upper surface.

13. The assembly as claimed in claim 1 wherein the seat member has an inner support surface on which the back member is supported within the first groove and at least one hole which extends between and fluidly communicates the first and second grooves of the seat member to prevent the accumulation of liquid within the groove.

14. The assembly as claimed in claim 1 further comprising concrete or grout positioned in the first elongated groove to seal the joint and rigidly lock the members together.

15. An interlocking precast slab bench comprising:

a precast seat member having upper and lower surfaces, an elongated groove formed in the upper surface and a pair of spaced elongated grooves found in the lower surface;

a precast back member having a front surface engraved with a photo-realistic image and an elongated lower edge portion which fits into the elongated groove formed in the upper surface to form a joint which interlocks the members together with the engraved front surface supported above the upper surface of the seat member for viewing; and a support including a pair of spaced, precast support members for supporting the seat member at a desired height, each of the support members having an upper edge portion which fits into one of the spaced elongated grooves formed in the lower surface of the seat member to form respective joints which interlock the seat member and the support members together wherein the seat member has an inner support surface on which the back member is supported within the groove in the upper surface and wherein the groove in the upper surface intersects the spaced elongated grooves formed in the lower surface to provide fluid communication between the groove in the upper surface and the spaced elongated grooves in the lower surface and to inhibit the accumulation of liquid within the groove in the upper surface.

16. The bench as claimed in claim 15 wherein the image includes at least one human image.

17. The bench as claimed in claim 15 wherein the front surface is also engraved with a memorial inscription.

18. The bench as claimed in claim 15 wherein the back member is a precast, non-shrink grout member.

19. An interlocking slab assembly comprising:

a precast seat member having upper and lower surfaces, a first elongated groove formed in the lower surface of the seat member, and a second elongated groove formed in the upper surface of the seat member, wherein the first and second grooves intersect to provide fluid communication between the grooves;

a precast back member having an engraved front surface and an elongated lower edge portion which fits into the second elongated groove to form a joint which interlocks the members together to form the assembly with the engraved front surface supported above the upper surface of the seat member for viewing wherein the front surface of the back member is engraved with a photo-realistic image; and wherein the back member is a precast grout member.

20. The assembly as claimed in claim 19 wherein the grout is a non-shrink grout.

* * * * *